US011402788B2

(12) United States Patent
Shiokawa

(10) Patent No.: US 11,402,788 B2
(45) Date of Patent: Aug. 2, 2022

(54) STABLE IMAGE FORMATION APPARATUS UTILIZING TONER RELEASE AGENTS

(71) Applicant: Konica Minolta, Inc., Tokyo (JP)

(72) Inventor: Yasuo Shiokawa, Hino (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 17/348,145

(22) Filed: Jun. 15, 2021

(65) Prior Publication Data

US 2021/0405570 A1 Dec. 30, 2021

(30) Foreign Application Priority Data

Jun. 24, 2020 (JP) ..... JP2020-109082

(51) Int. Cl.
*G03G 15/00* (2006.01)
*G03G 21/20* (2006.01)

(52) U.S. Cl.
CPC ..... *G03G 15/6573* (2013.01); *G03G 15/6579* (2013.01); *G03G 21/206* (2013.01); *G03G 2215/0043* (2013.01); *G03G 2221/1645* (2013.01)

(58) Field of Classification Search
CPC ..... G03G 15/6573; G03G 21/206; G03G 2221/1645; G03G 15/234; G03G 15/6579; G03G 2215/0043; G03G 2215/00438; G03G 2215/007
See application file for complete search history.

(56) References Cited

U.S. PATENT DOCUMENTS

2015/0338796 A1* 11/2015 Koga ..... G03G 15/2025 399/341
2016/0334749 A1* 11/2016 Iwasaki ..... G03G 15/6573
2019/0193969 A1* 6/2019 Yoshida ..... B65H 29/52
2020/0218181 A1* 7/2020 Midorikawa ..... G03G 15/2021
2021/0048772 A1* 2/2021 Hayashi ..... G03G 15/6573
2021/0070074 A1* 3/2021 Satake ..... B41J 11/007

FOREIGN PATENT DOCUMENTS

JP 2013-148740 8/2013

* cited by examiner

*Primary Examiner* — Walter L Lindsay, Jr.
*Assistant Examiner* — Laura Roth
(74) *Attorney, Agent, or Firm* — BakerHostetler

(57) ABSTRACT

An image forming apparatus forms a stable image on a recording material by using toner containing a release agent. A toner image can be formed on the recording material using a fixer, and a reverse transport path arranged on a downstream side of the fixer can reverses and transports the recording material after fixing. A reverse roller provided on the reverse transport path can reverse and send out the recording material by reversely transporting the recording material. A transporter can be provided between the fixer and the reverse roller on the reverse transport path, and a release agent remover removes the release agent adhering to the reverse roller. In embodiments, the transporter can include a release agent adhesion preventer that prevents the release agent from adhering to the transporter.

15 Claims, 4 Drawing Sheets

STABLE IMAGE FORMATION APPARATUS UTILIZING TONER RELEASE AGENTS

The entire disclosure of Japanese patent Application No. 2020-109082, filed on Jun. 24, 2020, is incorporated herein by reference in its entirety.

BACKGROUND

Technological Field

The present invention relates to an image forming apparatus that forms an image on a recording material by use of toner containing a release agent.

Description of the Related Art

Generally, in an electrophotographic image forming apparatus such as a copier or a printer, a uniformly charged photoreceptor (for example, a photoreceptor drum) is irradiated with (exposed to) light based on input image data, so that an electrostatic latent image is formed on a surface of the photoreceptor. A developing unit then supplies toner to the photoreceptor on which the electrostatic latent image is formed, so that the electrostatic latent image is visualized and a toner image is formed. This toner image is transferred to a recording material directly or indirectly via an intermediate transfer body (for example, an intermediate transfer belt), and the recording material is then heated and pressurized by a fixer to form an image on the recording material (see, for example, JP 2013-148740 A).

Furthermore, in order to form images on both sides of the recording material, a reverse transport path for reversing and transporting the recording material after fixing is arranged in the image forming apparatus. The recording material is reversely transported by a reverse roller provided on the reverse transport path, so that the recording material after fixing is reversed and sent out.

Such an image forming apparatus uses wax-containing toner in which toner particles contain a release agent, to ensure the peelability between a fixing surface side member of the fixer and the recording material.

However, in such an image forming apparatus, the release agent on the recording material discharged from the fixer may adhere to the reverse roller to reduce a transport force, which may cause poor transport of the recording material by the reverse roller. Therefore, a stable output image cannot be obtained.

Meanwhile, in recent years, in order to reduce an environmental load, it has been required to reduce the power consumption of the fixer, and in response to such requirement, toner having a low melting point, which has an excellent low-temperature fixability, is being developed. However, in the toner having a low melting point, a melting point (freezing point) of the release agent is also low. Thus, the release agent cannot be sufficiently cooled and solidified after fixing, and the release agent that is not solidified yet may adhere to a transporter arranged on the downstream side of the fixer. When the release agent adhering to the transporter is transferred to a subsequent recording material, image defects such as non-uniform gloss occur, and a stable output image cannot be obtained.

SUMMARY

The present invention has been made in view of the above circumstances, and an object of the present invention is to provide an image forming apparatus capable of obtaining a stable output image.

To achieve the abovementioned object, according to an aspect of the present invention, there is provided an image forming apparatus that forms an image on a recording material by using toner containing a release agent, and the image forming apparatus reflecting one aspect of the present invention comprises: a fixer that fixes, on the recording material, a toner image formed on the recording material; a reverse transport path that is arranged on a downstream side of the fixer in a recording material transport direction and reverses and transports the recording material after fixing; a reverse roller that is provided on the reverse transport path and reverses and sends out the recording material by reversely transporting the recording material; a transporter that is provided between the fixer and the reverse roller on the reverse transport path; and a release agent remover that removes the release agent adhering to the reverse roller, wherein the transporter includes a release agent adhesion preventer that prevents the release agent from adhering to the transporter.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
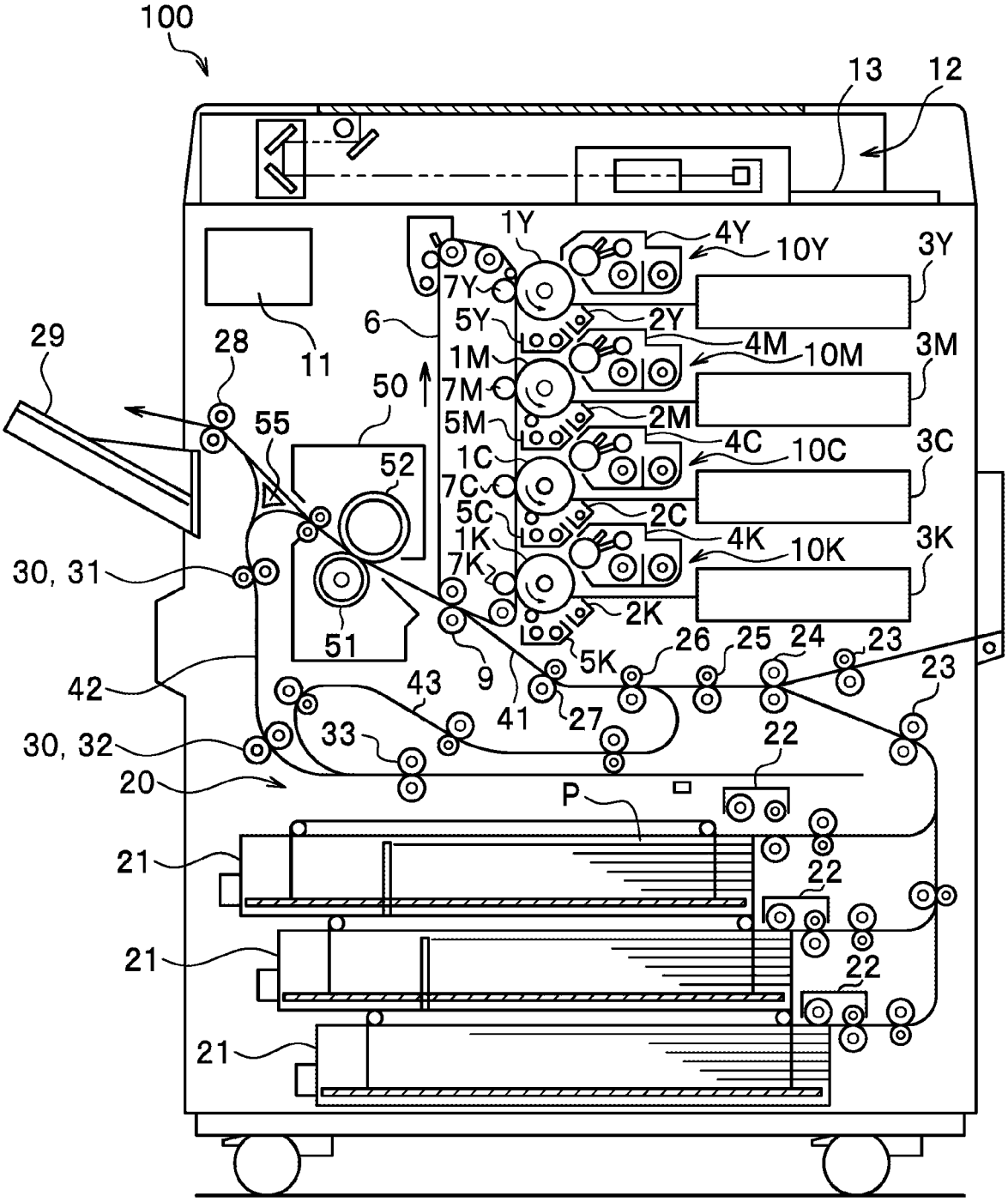
FIG. 1 is configuration diagram schematically illustrating an image forming apparatus according to an embodiment of the present invention.

Hereinafter, one or more embodiments of the present invention will be described with reference to the drawings. However, the scope of the invention is not limited to the disclosed embodiments.

In each drawing, the same or homogeneous components are designated by the same reference numerals, and duplicate description thereof will be omitted as appropriate.

FIG. 1 is a configuration diagram schematically illustrating an image forming apparatus 100 according to an embodiment of the present invention.

The image forming apparatus 100 illustrated in FIG. 1 is an electrophotographic image forming apparatus such as a copier. The image forming apparatus 100 is a so-called tandem type color image forming apparatus that forms a full-color image by vertically arranging a plurality of photoreceptors facing one intermediate transfer belt.

The image forming apparatus 100 mainly includes a document reading device 12, four sets of image forming units 10Y, 10M, 10C, and 10K, a fixer 50, and a controller 11, and these are housed in one housing.

The document reading device 12 scans and exposes an image of a document with an optical system of a scanning exposure device, reads reflected light of the image with a line image sensor, and thus obtains an image signal. This image signal is input to the controller 11 as image data after being subjected to processing such as analog-to-digital conversion, shading correction, and compression. Note that the image data input to the controller 11 is not limited to the image data read by the document reading device 12, but may be, for example, image data received from a personal computer connected to the image forming apparatus 100 or another image forming apparatus.

The image forming unit 10Y forms a yellow (Y) image, the image forming unit 10M forms a magenta (M) image, the image forming unit 10C, forms a cyan (C) image, and the image forming unit 10K forms a black (K) image.

The image forming unit 10Y includes a photoreceptor drum 1Y, a charging unit 2Y arranged around the photoreceptor drum 1Y, an optical writing unit 3Y, a developing device 4Y, and a drum cleaner 5Y. Similarly, the image forming units 10M, 10C, and 10K includes photoreceptor drums 1M, 1C, and 1K, charging units 2M, 2C, and 2K arranged around the photoreceptor drums 1M, 1C, and 1K, optical writing units 3M, 3C, and 3K, and developing devices 4M, 4C, and 4K, and drum cleaners 5M, 5C, and 5K, respectively.

Surfaces of the photoreceptor drums 1Y to 1K are uniformly charged by the charging units 2Y to 2K, and latent images are formed on the photoreceptor drums 1Y to 1K by scanning exposure with the optical writing units 3Y to 3K. Furthermore, the developing devices 4Y to 4K visualize the latent images on the photoreceptor drums 1Y to 1K by developing the latent images with toner. As the toner, wax-containing toner in which toner particles contain a release agent is used. As a result, a toner image of a predetermined color corresponding to one of yellow, magenta, cyan, and black is formed on corresponding one of the photoreceptor drums 1Y to 1K. The toner images formed on the photoreceptor drums 1Y to 1K is sequentially transferred to predetermined positions on a rotating intermediate transfer belt 6 by primary transfer rollers 7Y, 7M, 7C, and 7K.

The toner image composed of the colors transferred on the intermediate transfer belt 6 is transferred by a secondary transfer roller 9 to a sheet P as a recording material supplied at a predetermined timing by a sheet feed device 20 described later. The secondary transfer roller 9 is arranged so as to be in pressure contact with the intermediate transfer belt 6.

The sheet P is housed in a sheet feed tray 21 of the sheet feed device 20, and the sheet P housed in the sheet feed tray 21 is taken in by a sheet feed unit 22 and sent out to a transport path. Alternatively, the sheet P is housed in a sheet feed tray of an external sheet feed device (not illustrated) connected to the image forming apparatus 100, and the sheet P held by the external sheet feed device is supplied from the external sheet feed device to the image forming apparatus 100, to be sent out to a main transport path 41.

On the main transport path 41, a plurality of transporters for transporting the sheet P is provided on the upstream side of a transfer position for transferring the toner image to the sheet P (that is, the pressure contact position between the intermediate transfer belt 6 and the secondary transfer roller 9). Each of the transporters includes a pair of rollers in pressure contact with each other, and at least one of the rollers is rotationally driven by a driver such as an electric motor, for example, to transport the sheet P. Specifically, intermediate transport rollers 23 to 25, a loop roller 26, and a resist roller 27 are provided as the transporters from the upstream side to the downstream side in a sheet transport direction.

The fixer 50 fixes the toner image on the sheet P on which the toner image is transferred by the secondary transfer roller 9. The fixer 50 includes, for example, a pair of fixing members 51 and 52 (for example, a pair of rollers) forming a fixing nip and a heater for heating one or both of the fixing members 51 and 52. The fixer 50 allows the sheet P to pass through the fixing nip in a process of transporting the sheet P, and thus fixes the toner image on the sheet P through the action of the pressurization by the pair of fixing members 51 and 52 and the heat of the fixing members 51 and 52.

The sheet P subjected to the fixing process by the fixer 50 is discharged by a sheet ejection roller 28 to a sheet ejection tray 29 attached to an outer side surface of the housing of the image forming apparatus 100.

When an image is also formed on a back surface of the sheet P, a switching gate 55 transports the sheet P that has finished forming an image on a front surface of the sheet P to a reverse transport path 42 below the switching gate 55. The reverse transport path 42 is arranged on the downstream side of the fixer in the recording material transport direction, and is a transport path for reversing and transporting the sheet P after fixing. The reverse transport path 42 is provided with a reverse roller (switchback roller) 33.

The reverse roller 33 sandwiches the transported sheet P, and then reversely transports the sheet P to reverse the sheet P and send out the sheet P to a sheet refeed transport path 43. The sheet P sent out to the sheet refeed transport path 43 is transported by a plurality of sheet refeed transporters and returned to the transfer position.

Figure 2:
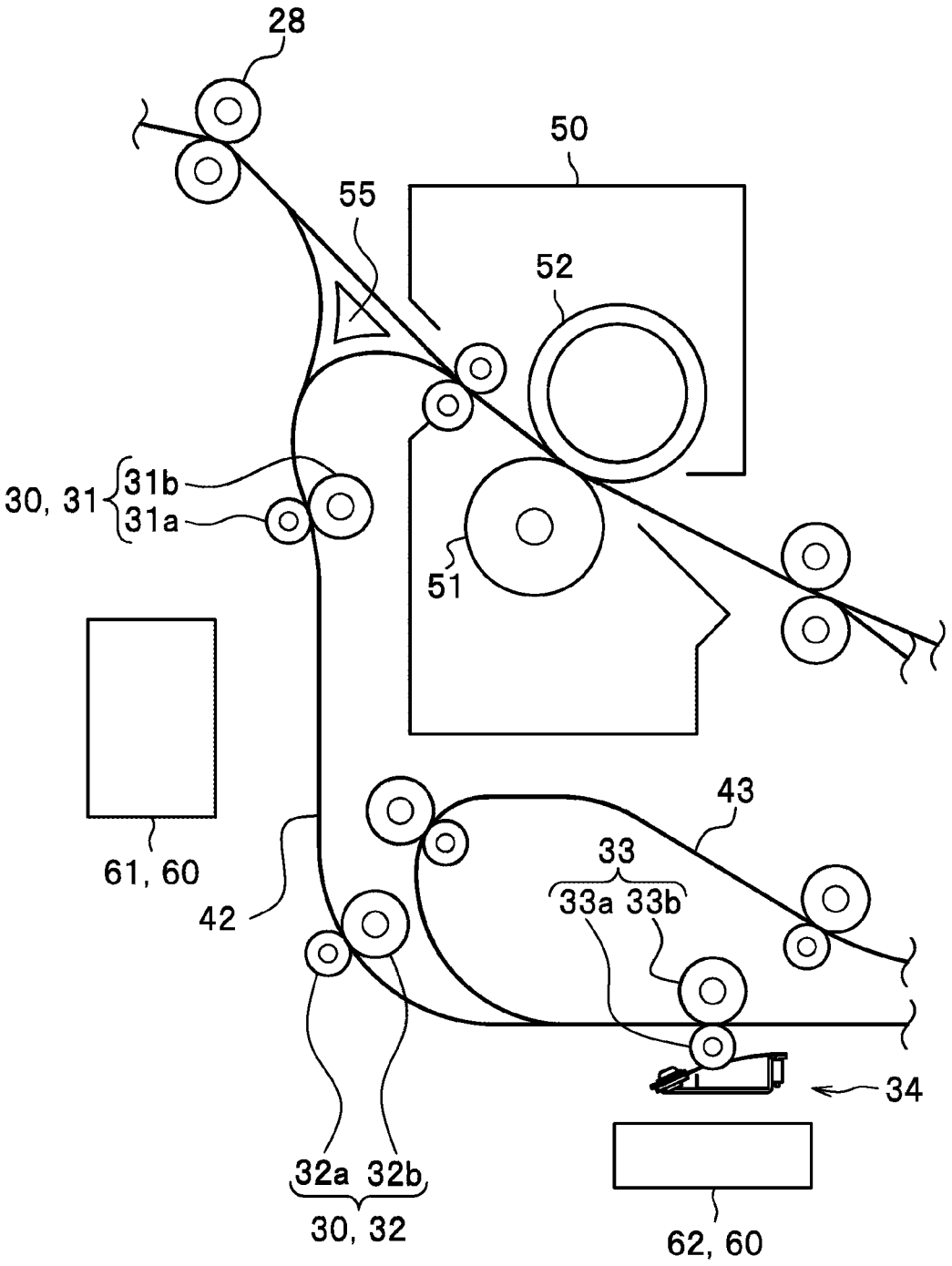
FIG. 2 is an enlarged view schematically illustrating the periphery of a reverse transport path of the image forming apparatus.

FIG. 2 is an enlarged view schematically illustrating the periphery of the reverse transport path 42 of the image forming apparatus 100.

As illustrated in FIG. 2, a transporter 30 is provided between the fixer 50 and the reverse roller 33 on the reverse transport path 42. The transporter 30 includes a first transporter 31 and a second transporter 32 provided on the downstream side of the first transporter 31 in the sheet transport direction.

The first transporter 31 includes a pair of rollers 31*a* and 31*b* through which the sheet P passes. The pair of rollers 31*a* and 31*b* are in pressure contact with each other. The roller 31*a*, out of the pair of rollers 31*a* and 31*b*, arranged on an image forming surface side of the sheet P with respect to the reverse transport path 42 is a roller having a surface layer made of a fluorine-based resin. The roller 31*a* functions as a release agent adhesion preventer that prevents the release agent from adhering to the first transporter 31.

As the fluorine-based resin, for example, perfluoroalkoxy alkane (PFA: copolymer of tetrafluoroethylene and perfluoroalkoxyethylene), polytetrafluoroethylene (PTFE), polyvinylidene fluoride (PVDF) or the like can be used. The surface layer of the roller 31*a* may be formed by a core metal being inserted into a fluorine-based resin tube, or may be formed by a surface of the core metal being coated with the fluorine-based resin.

The first transporter 31 may have a function of removing curl generated by fixing. The curl of the sheet P is mainly generated by the difference in hardness or the difference in heating temperature between the fixing members 51 and 52. In this case, the first transporter 31 is configured to apply curl in an opposite direction to the curl generated on the sheet P.

The second transporter 32 includes a pair of rollers 32*a* and 32*b* through which the sheet P passes. The pair of rollers 32*a* and 32*b* are in pressure contact with each other. The roller 32*a*, out of the pair of rollers 32*a* and 32*b*, arranged on the image forming surface side of the sheet P with respect to the reverse transport path 42 is a roller having a surface layer made of a foamed silicone. The roller 32*a* functions as a release agent adhesion preventer that prevents the release agent from adhering to the second transporter 32.

The foamed silicone has a function of being able to absorb the release agent. Therefore, a part of the release agent that is in a molten state on the sheet P is absorbed by the surface layer made of the foamed silicone included in the roller 32*a*. Therefore, the release agent is less likely to accumulate on a surface of the surface layer of the roller 32*a*. Note that it is desirable that the roller 32*a* of the second transporter 32 is replaced regularly so as to ensure the function of absorbing the release agent.

Furthermore, the image forming apparatus 100 includes a cooler 60 that cools the sheet P by flowing air to the reverse roller 33 from the upstream side of the reverse roller 33 on the reverse transport path 42 in the sheet transport direction. The cooler 60 includes a fan device 61 provided so as to face a side surface of the reverse transport path 42 on the left side in FIG. 2. The left side of the reverse transport path 42 in FIG. 2 corresponds to the outside side of the image forming apparatus 100, that is, the outer side of the apparatus.

Furthermore, the cooler 60 includes an air bleeder 62 arranged on the side opposite to the fixer 50 with respect to the reverse roller 33 (here, the lower side of the reverse roller 33). The air bleeder 62 is a portion for bleeding the air, such as an opening through which the air sent from the fan device 61 flows out. The cooler 60 is configured to cool the sheet P to a temperature equal to or lower than a crystallization temperature of the release agent when the sheet P reaches the reverse roller 33.

Figure 3:
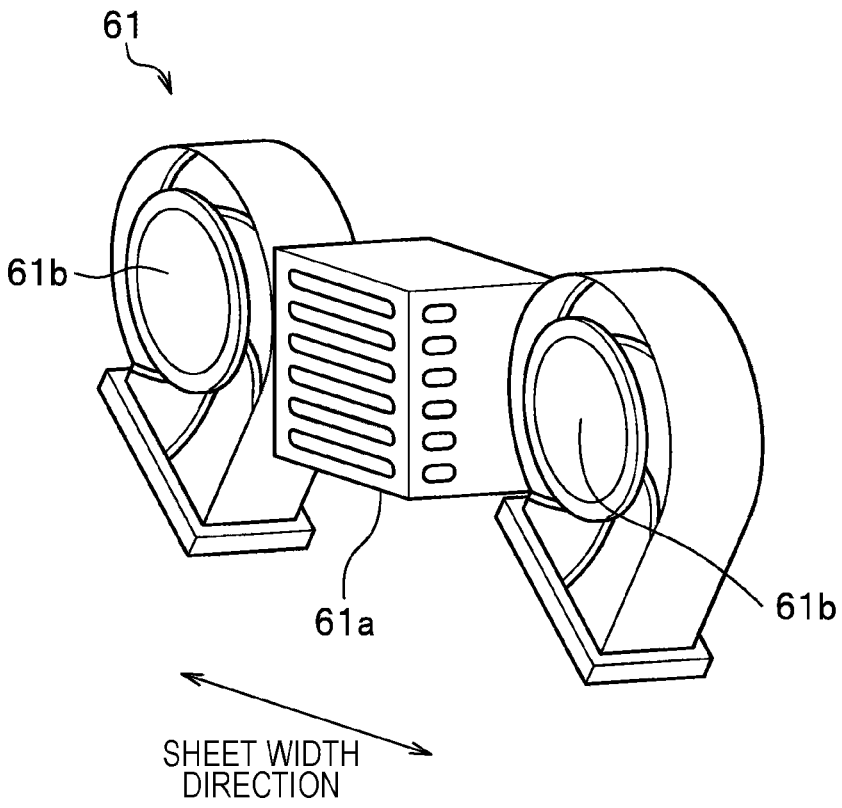
FIG. 3 is an enlarged perspective view schematically illustrating a fan device of a cooler.

FIG. 3 is an enlarged perspective view schematically illustrating the fan device 61 of the cooler 60.

As illustrated in FIG. 3, the fan device 61 includes a central fan 61*a* and end fans 61*b*. The central fan 61*a* is arranged in the center in a sheet width direction and blows toward the inside of the apparatus. The end fans 61*b* are arranged on both end sides in the sheet width direction, and blow toward the outside of the apparatus.

Figure 4:
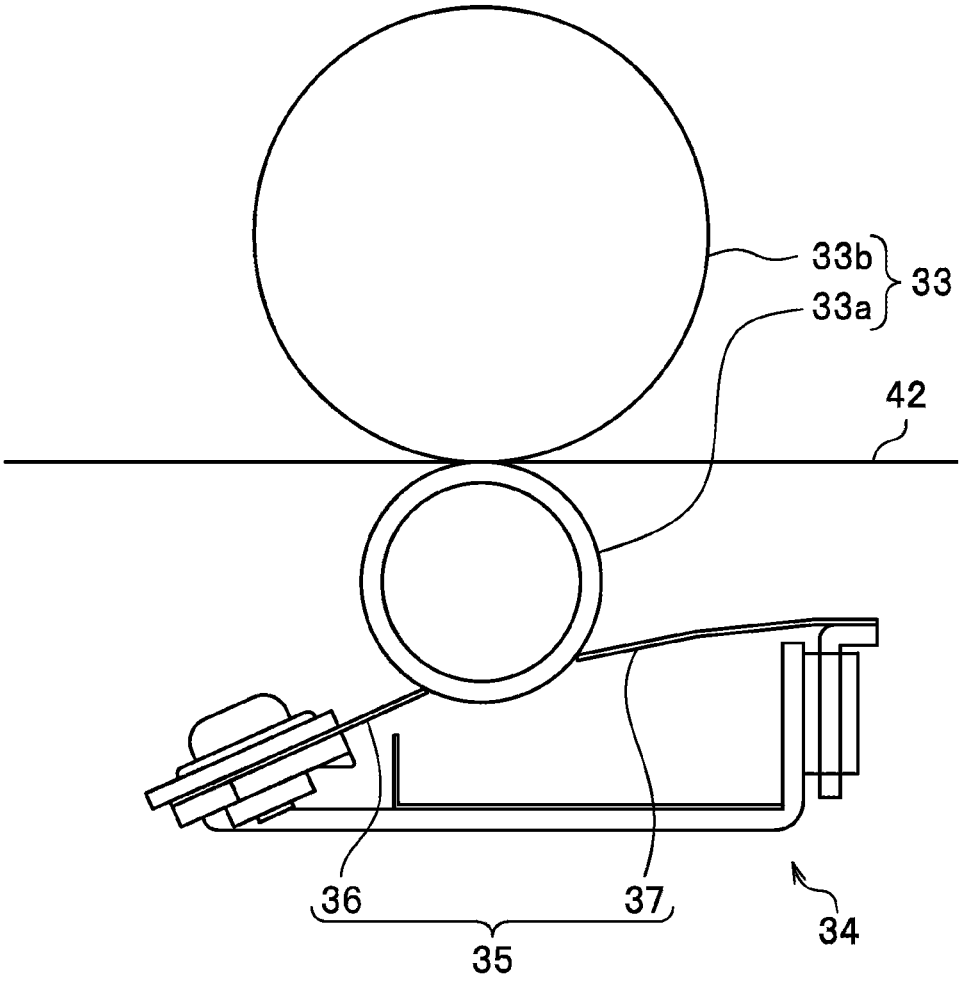
FIG. 4 is an enlarged view schematically illustrating the periphery of a reverse roller.

FIG. 4 is an enlarged view schematically illustrating the periphery of the reverse roller 33.

As illustrated in FIG. 4, the reverse roller 33 includes a pair of rollers 33*a* and 33*b* through which the sheet P passes. The pair of rollers 33*a* and 33*b* are in pressure contact with each other. The roller 33*a*, out of the pair of rollers 33*a* and 33*b*, arranged on the image forming surface side of the sheet P with respect to the reverse transport path 42 is a follower roller. The roller 33*b*, out of the pair of rollers 33*a* and 33*b*, is a drive roller that is rotationally driven by a driver (not illustrated).

When the sheet P is drawn from the fixer 50 to the reverse transport path 42, the roller 33*b* of the reverse roller 33 rotates counterclockwise and the roller 33*a* of the reverse roller 33 rotates clockwise in FIG. 4. On the other hand, when the sheet P is reversely transported and sent out to the sheet refeed transport path 43, the reverse roller 33 rotates in a direction opposite to that in drawing the sheet P to the reverse transport path 42.

The roller 33*a*, which is the follower roller, has the same outer diameter over the entire area of the sheet in the sheet width direction. That is, the roller 33*a* is a so-called through roller, and has an outer peripheral surface that is continuous along an axial direction of the roller 33*a* and has a constant diameter.

The reverse roller 33 is provided with a release agent remover 34 that removes the release agent adhering to the reverse roller 33. The release agent remover 34 includes a scraper 35 that abuts on the outer peripheral surface of the roller 33*a*, which is the follower roller of the pair of rollers 33*a* and 33*b* of the reverse roller 33, and scrapes off the release agent adhering to the roller 33*a* to remove the release agent. The roller 33*a*, which is the follower roller, and the scraper 35 are arranged on the image forming surface side of the sheet P with respect to the reverse transport path 42.

The scraper 35 includes a main scraper 36 and a sub scraper 37. A tip of the main scraper 36 abuts on the outer peripheral surface of the roller 33*a* of the reverse roller 33 in a counter direction (a direction in which the tip is stretched) when the sheet P is drawn to the reverse transport path 42. A tip of the sub scraper 37 abuts on the outer peripheral surface of the roller 33*a* of the reverse roller 33 in a trail direction (a direction in which the tip is trailed) when the sheet P is drawn to the reverse transport path 42.

As illustrated in FIG. 1, the controller 11 is a computer including a CPU, a memory such as a ROM and a RAM, an HDD as an auxiliary storage device, a communication interface unit, and the like, and these elements are mutually connected via a bus. The controller 11 has a function of integrally controlling the image forming apparatus 100.

An operation unit 13 outputs various types of information set by a user to the controller 11. As the operation unit 13, for example, a touch panel capable of performing an input operation according to information displayed on a display can be used. Through the operation unit 13, the user can set printing conditions, that is, the type of the sheet P (for example, the basis weight and size), the density and magnification of an image, and the like. Furthermore, the controller 11 can display various messages to the user via the operation unit 13 by controlling the operation unit 13.

The cooler 60 changes the volume of the air by the fan device 61 depending on the type of the sheet P based on a command from the controller 11. This operation is to cope with the difference in the ease with which the release agent on the sheet P is cooled depending on the type of the sheet P. Examples of the type of the sheet P include, for example, thin paper, thick paper, plain paper, coated paper, and the like.

In a case where the sheet P is a sheet of thin paper having a basis weight smaller than a predetermined value, the cooler 60 makes the volume of the air smaller than in a case where the basis weight of the sheet P is equal to or larger than the predetermined value. For example, in a case where the sheet P is a sheet of thin paper having a basis weight of 64 gsm ($g/m^2$) or less, the volume of the air is made smaller than usual and the cooling capacity is lowered because the sheet P is already cooled immediately after fixing. Alternatively, the fan device 61 may be stopped to give priority to a sheet passing property, so that the sheet P may be prevented from being deformed and causing jam when the air is applied to the sheet of thin paper. On the other hand, for example, in a case where the sheet P is a sheet of thick paper having a basis weight of 300 gsm ($g/m^2$) or more, the sheet P easily stores heat, and thus the volume of the air is made larger than usual and the cooling capacity is increased. Alternatively, the transport speed of the sheet P may be lowered to increase the cooling capacity.

Furthermore, in a case where the sheet P is a sheet of coated paper whose surface is coated, the cooler 60 makes the volume of the air larger than in a case where the sheet P is a sheet of plain paper whose surface is not coated. This is because, in the case where the sheet P is the sheet of coated paper, the release agent tends to come out on the surface since the surface of the sheet P has a coating component while, in the case where the sheet P is the sheet of plain paper, the release agent is easily absorbed inside the sheet P.

Furthermore, the cooler 60 changes the volume of the air by the fan device 61 according to environmental conditions at the time of image formation on the sheet P based on a command from the controller 11. This operation is to cope with the difference in the ease with which the release agent on the sheet P is cooled, which is caused by the temperature inside the apparatus changing depending on the environmental conditions. Examples of the environmental conditions include the season, temperature, and the like.

As described above, the image forming apparatus 100 according to the present embodiment includes the reverse transport path 42 arranged on the downstream side of the fixer 50 in the sheet transport direction, and the reverse roller 33 provided on the reverse transport path 42. Furthermore, the image forming apparatus 100 includes the transporter 30 provided between the fixer 50 and the reverse roller 33 on the reverse transport path 42, and the release agent remover 34 that removes the release agent adhering to the reverse roller 33. The transporter 30 includes the release agent adhesion preventer that prevents the release agent from adhering to the transporter 30.

In the present embodiment, the release agent on the sheet P is not yet solidified on the downstream side of the fixer 50 and the upstream side of the reverse roller 33. However, since the transporter 30 provided between the fixer 50 and the reverse roller 33 includes the release agent adhesion preventer, it is possible to prevent the release agent from adhering to the transporter 30. Meanwhile, the release agent on the sheet P is cooled and almost solidified by the time the sheet P reaches the reverse roller 33, and adheres to the reverse roller 33. The release agent adhering to the reverse roller 33 is then removed by the release agent remover 34.

As described above, it is possible to allow the release agent on the sheet P after fixing to adhere to the reverse roller 33 without adhering to the transporter 30 provided between the fixer 50 and the reverse roller 33, and remove the release agent adhering to the reverse roller 33.

As a result, it is possible to prevent the release agent adhering to the transporter 30 from being transferred to a subsequent sheet P and causing image defects. Furthermore, it is possible to prevent the release agent adhering to the reverse roller 33 from reducing a transport force of the reverse roller 33 and causing poor transport of the sheet P.

That is, according to the present embodiment, it is possible to provide the image forming apparatus 100 capable of obtaining a stable output image.

Furthermore, in the present embodiment, the release agent adhesion preventer is the roller 31*a* having the surface layer made of the fluorine-based resin. In this configuration, since the release agent can be repelled by the surface layer made of the fluorine-based resin, which has a non-adhesive surface property, it is possible to prevent the release agent from adhering to the transporter 30.

Furthermore, in the present embodiment, the release agent adhesion preventer is the roller 32*a* having the surface layer made of the foamed silicone. In this configuration, since the release agent is less likely to accumulate on the surface of the surface layer made of the foamed silicone, it is possible to prevent the release agent from adhering to the transporter 30.

Furthermore, in the present embodiment, the transporter 30 includes the first transporter 31 and the second transporter 32 provided on the downstream side of the first transporter 31 in the sheet transport direction. The release agent adhesion preventer of the first transporter 31 is the roller 31*a* having the surface layer made of the fluorine-based resin, and the release agent adhesion preventer of the second transporter 32 is the roller 32*a* having the surface layer made of the foamed silicone. In this configuration, since the roller 31*a* of the first transporter 31 having the surface layer made of the fluorine-based resin has high heat resistance, the roller 31*a* is arranged on the side close to the fixer 50 and can sufficiently deal with even a case where the temperature of the sheet P is high. Meanwhile, since the roller 32*a* of the second transporter 32 having the surface layer made of the foamed silicone has a cushioning property as a foaming material, the transport force for the recording material can be increased. The roller 32*a* having the surface layer made of the foamed silicone as described above is suitable for being arranged and used at a bent portion of the reverse transport path 42 as in the present embodiment, which requires the transport force for the sheet P.

Furthermore, the present embodiment includes the cooler 60 that cools the sheet P by flowing air to the reverse roller 33 from the upstream side of the reverse roller 33 on the reverse transport path 42 in the sheet transport direction. In this configuration, the sheet P discharged from the fixer 50 can be sufficiently cooled by the time the sheet P reaches the reverse roller 33. As a result, the release agent on the sheet P can be almost solidified by the time the sheet P reaches the reverse roller 33, adhered to the reverse roller 33, and then efficiently removed by the release agent remover 34.

Furthermore, in the present embodiment, the cooler 60 includes the fan device 61 provided so as to face the side surface of the reverse transport path 42 on the outer side of the image forming apparatus 100. In this configuration, the fan device 61 that blows the air toward the surface of the sheet P passing through the reverse transport path 42 can be arranged without affecting the layout of the transport path for the sheet P.

Furthermore, in the present embodiment, the fan device 61 includes the central fan 61*a* that is arranged in the center in the sheet width direction and blows toward the inside of the image forming apparatus 100, and the end fans 61*b* that are arranged on both end sides in the sheet width direction and blow toward the outside of the image forming apparatus 100. With this configuration, it is possible to prevent the pressure inside the apparatus from becoming too high and making it difficult for the air to enter the apparatus. That is, the inflow of the air by the central fan 61*a* and the outflow of the air by the end fans 61*b* are balanced, so that the air can flow efficiently and the sheet P can be cooled.

Furthermore, in the present embodiment, the cooler 60 includes the air bleeder 62 that is arranged on the side opposite to the fixer 50 with respect to the reverse roller 33 and bleeds the air. In this configuration, the air flows from the upstream side of the reverse roller 33 through the reverse roller 33 so as to be bled through the air bleeder 62. As a result, since the air can flow along the reverse transport path 42, the sheet P can be cooled efficiently. In addition, since the reverse roller 33 can be cooled efficiently, a recovery rate of the release agent is increased. Note that a fan such as an axial fan may be arranged below the air bleeder 62 in FIG. 2 (on the side opposite to the reverse roller 33), so that the internal pressure inside the apparatus may be positively reduced to ensure the flow of the air from the fan device 61 to the air bleeder 62.

Furthermore, in the present embodiment, the cooler 60 cools the sheet P to a temperature equal to or lower than the crystallization temperature of the release agent when the sheet P reaches the reverse roller 33. In this configuration, the release agent on the sheet P can be solidified by the time the sheet P reaches the reverse roller 33, adhered to the reverse roller 33, and then efficiently removed by the release agent remover 34. Therefore, it is possible to prevent the release agent from adhering to a roller arranged on the downstream side of the reverse roller 33, for example, on the sheet refeed transport path 43, and causing fouling.

Furthermore, in the present embodiment, the cooler 60 changes the volume of the air depending on the type of the sheet P. The ease with which the release agent on the sheet P is cooled differs depending on the type of the sheet P, but in this configuration, the sheet P can be cooled with an appropriate volume of the air according to the type of the sheet P.

Furthermore, in the present embodiment, in a case where the sheet P is a sheet of thin paper having a basis weight smaller than a predetermined value, the cooler 60 makes the volume of the air smaller than in a case where the basis weight of the sheet P is equal to or larger than the predetermined value. In this configuration, in the case where the sheet P is the sheet of thin paper, the sheet P can be sufficiently cooled even if the volume of the air is reduced, and it is also possible to prevent a too large air volume from deforming the recording material and causing jam, so that the sheet passing property can be ensured.

Furthermore, in the present embodiment, the cooler 60 changes the volume of the air according to the environmental conditions at the time of image formation on the sheet P. The ease with which the sheet P is cooled differs depending on the environmental conditions at the time of image formation, such as the season and temperature, but in this configuration, the sheet P can be cooled with an appropriate volume of the air according to the environmental conditions at the time of image formation.

Furthermore, in the present embodiment, the release agent remover 34 includes the scraper 35 that abuts on the outer peripheral surface of the reverse roller 33 and scrapes off the release agent adhering to the reverse roller 33 to remove the release agent. The scraper 35 includes the main scraper 36 whose tip abuts on the outer peripheral surface of the reverse roller 33 in the counter direction when the sheet P is drawn to the reverse transport path 42, and the sub scraper 37 whose tip abuts on the outer peripheral surface of the reverse roller 33 in the trail direction when the sheet P is drawn to the reverse transport path 42. In this configuration, the main scraper 36 can scrape off the release agent adhering to the reverse roller 33 to efficiently remove the release agent when the sheet P is drawn to the reverse transport path 42. Furthermore, the sub scraper 37 can scrape off the release agent when the sheet P is reversely transported, and can also prevent the scraped release agent from overflowing from the release agent remover 34.

Furthermore, in the present embodiment, the reverse roller 33 includes the pair of rollers 33*a* and 33*b* through which the sheet P passes, and the scraper 35 abuts on the roller 33*a*, which is the follower roller of the pair of rollers 33*a* and 33*b*. The roller 33*a*, which is the follower roller, has the same outer diameter over the entire area of the sheet P in the sheet width direction. In this configuration, the roller 33*a*, which is the follower roller of the pair of rollers 33*a* and 33*b* of the reverse roller 33, is the through roller, and thus the through roller and the sheet P can be brought into contact with each other uniformly in the axial direction. As a result, the release agent on the sheet P can be adhered to the through roller and efficiently scraped off from the through roller by the scraper 35.

Furthermore, in the present embodiment, the roller 33*a*, which is the follower roller, and the scraper 35 are arranged on the image forming surface side of the sheet P with respect to the reverse transport path 42. In this configuration, the release agent can be adhered to the roller 33*a*, which is the follower roller of the pair of rollers 33*a* and 33*b* of the reverse roller 33, and the release agent can be surely scraped off from the roller 33*a*, which is the follower roller, by the scraper 35.

Although embodiments of the present invention have been described and illustrated in detail, the disclosed embodiments are made for purposes of illustration and example only and not limitation, and can be appropriately modified without departing from the spirit of the present invention. The scope of the present invention should be interpreted by terms of the appended claims. In addition, a part of the configuration of the above-described embodiment can be added, deleted, or replaced.

For example, in the above-described embodiment, the image forming apparatus 100 is a tandem type color image forming apparatus. However, the image forming apparatus 100 is not limited to this, and may be, for example, a simple drum type image forming apparatus corresponding to black and white printing.

Furthermore, in the above-described embodiment, the transporter 30 includes the pair of rollers. However, the transporter 30 may employ a combination of belts or a combination of a belt and a roller, in addition to including the pair of rollers.

What is claimed is:

1. An image forming apparatus that forms an image on a recording material by using toner containing a release agent, the image forming apparatus comprising:

a fixer that fixes, on the recording material, a toner image formed on the recording material;

a reverse transport path that is arranged on a downstream side of the fixer in a recording material transport direction and reverses and transports the recording material after fixing;

a reverse roller that is provided on the reverse transport path and reverses and sends out the recording material by reversely transporting the recording material;

a transporter that is provided between the fixer and the reverse roller on the reverse transport path; and a release agent remover that removes the release agent adhering to the reverse roller, wherein the transporter includes a release agent adhesion preventer that prevents the release agent from adhering to the transporter.

2. The image forming apparatus according to claim 1, wherein the release agent adhesion preventer is a roller having a surface layer made of a fluorine-based resin.

3. The image forming apparatus according to claim 1, wherein the release agent adhesion preventer is a roller having a surface layer made of a foamed silicone.

4. The image forming apparatus according to claim 1, wherein the transporter includes a first transporter and a second transporter provided on a downstream side of the first transporter in the recording material transport direction, the release agent adhesion preventer of the first transporter is a roller having a surface layer made of a fluorine-based resin, and the release agent adhesion preventer of the second transporter is a roller having a surface layer made of a foamed silicone.

5. The image forming apparatus according to claim 1, further comprising a cooler that cools the recording material.

6. The image apparatus according to claim 5, wherein the cooler includes a fan device provided so as to face a side surface of the reverse transport path on an outer side of the image forming apparatus.

7. The image forming apparatus according to claim 6, wherein the fan device includes a central fan that is arranged in a center in a recording material width direction and blows toward an inside of the image forming apparatus, and end fans that are arranged on both end sides in the recording material width direction and blow toward an outside of the image forming apparatus.

8. The image forming apparatus according to claim 5, wherein the cooler includes an air bleeder that is arranged on a side opposite to the fixer with respect to the reverse roller.

9. The image forming apparatus according to claim 5, wherein the cooler cools the recording material to a temperature equal to or lower than a crystallization temperature of the release agent when the recording material reaches the reverse roller.

10. The image forming apparatus according to claim 5, wherein the cooler changes a volume of the air depending on a type of sheet.

11. The image forming apparatus according to claim 10, wherein, in a case where the recording material is sheet of thin paper having basis weight smaller than a predetermined value, the cooler makes the volume of the air smaller than in a case where the basis weight or the recording material is equal to or larger than the predetermined value.

12. The image forming apparatus according to claim 5, wherein the cooler changes the volume of the air according to environmental conditions at a time of image formation on the recording material.

13. The image forming apparatus according to claim 1, wherein the release agent remover includes a scraper that abuts on an outer peripheral surface of the reverse roller and scrapes off the release agent adhering to the reverse roller to remove the release agent, and the scraper includes a main scraper whose tip abuts on the outer peripheral surface of the reverse roller in a direction in which the tip is stretched when the recording material is drawn to the reverse transport path, and a sub scraper whose tip abuts on the outer peripheral surface of the reverse roller in a direction in which the tip is trailed when the recording material is drawn to the reverse transport path.

14. The image forming apparatus according to claim 13, wherein the reverse roller includes a pair of rollers through which the recording material passes, the scraper abuts on a follower roller of the pair of rollers, and the follower roller has a same outer diameter over an entire area of the recording material in a recording material width direction.

15. The image forming apparatus according to claim 14, wherein the follower roller and the scraper are arranged on an image forming surface side of the recording material with respect to the reverse transport path.

* * * * *